US010991336B2

(12) United States Patent
Lu et al.

(10) Patent No.: US 10,991,336 B2
(45) Date of Patent: Apr. 27, 2021

(54) VOLTAGE ADJUSTMENT METHOD, VOLTAGE ADJUSTMENT DEVICE AND DISPLAY DEVICE

(71) Applicants: CHONGQING BOE OPTOELECTRONICS TECHNOLOGY CO., LTD., Chongqing (CN); BOE TECHNOLOGY GROUP CO., LTD., Beijing (CN)

(72) Inventors: Xu Lu, Beijing (CN); Siqing Fu, Beijing (CN); Xinghong Liu, Beijing (CN); Yunsong Li, Beijing (CN)

(73) Assignees: CHONGQING BOE OPTOELECTRONICS TECHNOLOGY CO., LTD., Chongqing (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/641,923

(22) PCT Filed: Apr. 11, 2019

(86) PCT No.: PCT/CN2019/082201
§ 371 (c)(1),
(2) Date: Feb. 25, 2020

(87) PCT Pub. No.: WO2019/205946
PCT Pub. Date: Oct. 31, 2019

(65) Prior Publication Data

US 2020/0258469 A1 Aug. 13, 2020

(30) Foreign Application Priority Data

Apr. 26, 2018 (CN) ..... 201810385205.4

(51) Int. Cl.
*G09G 5/00* (2006.01)
*G09G 3/36* (2006.01)

(52) U.S. Cl.
CPC ... *G09G 3/3696* (2013.01); *G09G 2310/0289* (2013.01); *G09G 2320/0673* (2013.01); *G09G 2330/021* (2013.01)

(58) Field of Classification Search
CPC .. G09G 3/36; G09G 3/34; G09G 3/32; G09G 5/00; G09G 5/10; G09G 5/02; G06F 3/038
See application file for complete search history.

(56) References Cited

U.S. PATENT DOCUMENTS

2009/0284456 A1 11/2009 Song et al.
2010/0033413 A1 2/2010 Song et al.
(Continued)

FOREIGN PATENT DOCUMENTS

CN 101587692 A 11/2009
CN 101645244 A 2/2010
(Continued)

OTHER PUBLICATIONS

First Office Action for Chinese Application No. 201810385205.4, dated Jul. 29, 2019, 7 Pages.
(Continued)

*Primary Examiner* — Pegeman Karimi
(74) *Attorney, Agent, or Firm* — Brooks Kushman P.C.

(57) ABSTRACT

A voltage adjustment method, a voltage adjustment device and a display device are provided. The voltage adjustment method is applied to a display device, and includes: determining an offset reference voltage, the offset reference voltage is smaller than or equal to a voltage obtained by subtracting a minimum gamma voltage of the display device from a minimum initial pixel voltage among initial pixel
(Continued)

voltages of all pixels on a display screen of a current frame of the display device; decreasing a common voltage of the display device by the offset reference voltage; and decreasing an initial pixel voltage of each pixel on the display screen of the current frame of the display device by the offset reference voltage.

11 Claims, 4 Drawing Sheets

(56) References Cited

U.S. PATENT DOCUMENTS

2014/0063079 A1 3/2014 Lee et al.
2014/0084932 A1* 3/2014 Chaji ..... G09G 3/3233 324/414
2014/0168194 A1* 6/2014 Kong ..... H01L 29/78645 345/212
2015/0364103 A1 12/2015 Hsu et al.
2016/0019839 A1* 1/2016 In ..... G09G 3/3258 345/212
2017/0345374 A1* 11/2017 Chen ..... G09G 3/3275

FOREIGN PATENT DOCUMENTS

CN 101859523 A 10/2010
CN 103185974 A 7/2013
CN 103680401 A 3/2014
CN 104200785 A 12/2014
CN 105469769 A 4/2016
CN 106652932 A 5/2017
CN 107452326 A 12/2017
CN 108597467 A 9/2018
KR 20120074915 A 7/2012

OTHER PUBLICATIONS

International Search Report and Written Opinion for Application No. PCT/CN2019/082201, dated Jul. 10, 2019, 12 Pages.

* cited by examiner

VOLTAGE ADJUSTMENT METHOD, VOLTAGE ADJUSTMENT DEVICE AND DISPLAY DEVICE

CROSS-REFERENCE TO RELATED APPLICATION APPLICATIONS

This application is the U.S. national phase of PCT Application No. PCT/CN2019082201 filed on Apr. 11, 2019, which claims priority to Chinese Patent Application No. 201810385205.4 filed on Apr. 26, 2018, which are incorporated herein by reference in their entireties.

TECHNICAL FIELD

The present disclosure relates to the field of display technology, in particular to a voltage adjustment method, a voltage adjustment device and a display device.

BACKGROUND

In recent years, a liquid crystal display, especially a product such as a notebook and a mobile terminal, makes increasingly enormous demands on power consumption. Since the liquid crystal display makes increasingly enormous demands on standby, a demand for reducing the power consumption of the liquid crystal display is also increasing.

In recent years, methods for reducing the power consumption of the liquid crystal display include: by using a high-efficiency power circuit, by using a low-voltage liquid crystal, and by using a high-process integrated circuit. However, an effect of reducing the power consumption by using the above methods is not obvious and an implementation cost is high.

SUMMARY

A voltage adjustment method, device, and a display device are provided in the present disclosure.

In one aspect, a voltage adjustment method is provided, applied to a display device, the voltage adjustment method includes:

determining an offset reference voltage, where the offset reference voltage is smaller than or equal to a voltage obtained by subtracting a minimum gamma voltage of the display device from a minimum initial pixel voltage among initial pixel voltages of all pixels on a display screen of a current frame of the display device;

decreasing a common voltage of the display device by the offset reference voltage; and decreasing an initial pixel voltage of each pixel on the display screen of the current frame of the display device by the offset reference voltage.

Further, the determining the offset reference voltage includes:

taking the voltage obtained by subtracting the minimum gamma voltage from the minimum initial pixel voltage of the display screen of the current frame of the display device as the offset reference voltage.

Further, the voltage adjustment method further includes:

subsequent to the decreasing the initial pixel voltage of each pixel on the display screen of the current frame of the display device by the offset reference voltage, decreasing a power supply voltage of the display device, to make a difference between the power supply voltage and a maximum pixel voltage among decreased pixel voltages of all pixels on the display screen of the current frame to be not larger than a preset threshold.

Further, the initial pixel voltage of each pixel on the display screen of the current frame is larger than the minimum gamma voltage, and the offset reference voltage is a positive voltage.

In another aspect, a voltage adjustment device is further provided in the embodiments of the present disclosure, applied to a display device, the voltage adjustment device includes:

a determining circuit, configured to determine an offset reference voltage, where the offset reference voltage is smaller than or equal to a voltage obtained by subtracting a minimum gamma voltage of the display device from a minimum initial pixel voltage among initial pixel voltages of all pixels on a display screen of a current frame of the display device; and a processing circuit, configured to decrease a common voltage of the display device by the offset reference voltage; and decrease an initial pixel voltage of each pixel on the display screen of the current frame of the display device by the offset reference voltage.

Further, the determining circuit is configured to take the voltage obtained by subtracting the minimum gamma voltage from the minimum initial pixel voltage of the display screen of the current frame of the display device as the offset reference voltage.

Further, the processing circuit is further configured to decrease a power supply voltage of the display device, to make a difference between the power supply voltage and a maximum pixel voltage among decreased pixel voltages of all pixels on the display screen of the current frame to be not larger than a preset threshold.

Further, the initial pixel voltage of each pixel on the display screen of the current frame is larger than the minimum gamma voltage, and the offset reference voltage is a positive voltage.

In another aspect, a voltage adjustment device is further provided in the embodiments of the present disclosure, including: a memory, a processor, and a computer program stored in the memory and executable by the processor, where the processor is configured to execute the computer program to perform the voltage adjustment method as described above.

In another aspect, a computer-readable storage medium is further provided in the embodiments of the present disclosure, storing a computer program, where the computer program is executed by a processor to perform the voltage adjustment method as described above.

In another aspect, a display device is further provided in the embodiments of the present disclosure, including the voltage adjustment device as described above.

DETAILED DESCRIPTION

In order to make the technical problem to be solved, the technical solution and advantages of the embodiments of the present disclosure clearer, a detailed description will be given below with reference to the accompanying drawings and specific embodiments.

A voltage adjustment method, a voltage adjustment device and a display device are provided in the embodiments of the present disclosure, which can effectively reduce power consumption of the display device.

Figure 1:
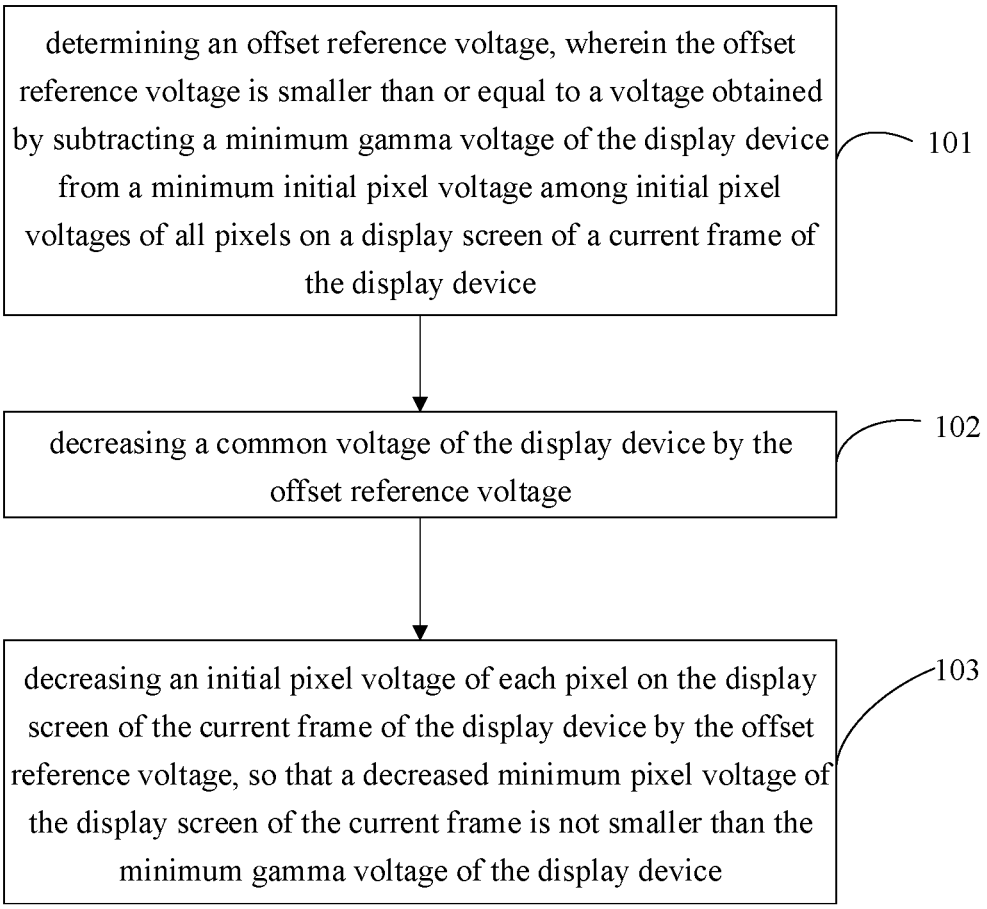
FIG. 1 is a schematic flowchart of a voltage adjustment method in an embodiment of the present disclosure.

A voltage adjustment method is provided, applied to a display device, as shown in FIG. 1, the voltage adjustment method includes:

determining an offset reference voltage, where the offset reference voltage is smaller than or equal to a voltage obtained by subtracting a minimum gamma voltage of the display device from a minimum initial pixel voltage among initial pixel voltages of all pixels on a display screen of a current frame of the display device;

decreasing a common voltage of the display device by the offset reference voltage; and decreasing an initial pixel voltage of each pixel on the display screen of the current frame of the display device by the offset reference voltage, so as to make the minimum pixel voltage decreased of the display screen of the current frame to be not smaller than the minimum gamma voltage of the display device.

In this embodiment, in the case that all pixel voltages of the display screen of the current frame are larger than the minimum gamma voltage of the display device, the common voltage and all the initial pixel voltages of the display screen of the current frame are simultaneously decreased, as long as the decreased minimum pixel voltage of the display screen of the current frame is not smaller than the minimum gamma voltage of the display device, and at the same time, a voltage difference between each pixel voltage of the display screen of the current frame and the common voltage may be maintained as a voltage difference required for normal display, so that voltages of the display screen of the current frame are at relatively low voltage levels, thereby reducing the power consumption of the display device.

Before reducing the common voltage and all the initial pixel voltages of the display screen of the current frame, it is necessary to determine the offset reference voltage. The offset reference voltage must ensure that the decreased minimum pixel voltage among the decreased initial pixel voltages of all the pixels on the display screen of the current frame is not smaller than the minimum gamma voltage of the display device. Since the common voltage and the initial pixel voltages of all pixels of the display screen of the current frame are decreased by a same magnitude, the voltage difference between each pixel voltage of the display screen of the current frame and the common voltage may be maintained as the voltage difference required for normal display, and a display of the display screen of the current frame may not be affected.

Specifically, the determining the offset reference voltage includes:

taking the voltage obtained by subtracting the minimum gamma voltage from the minimum initial pixel voltage of the display screen of the current frame of the display device as the offset reference voltage. Thus, the decreased minimum pixel voltage of the display screen of the current frame is equal to the minimum gamma voltage of the display device, which can reduce voltage levels of the display screen of the current frame to a maximum magnitude while ensuring the normal display of the display device, thereby reducing the power consumption of the display device to the full extent.

Of course, the method for determining the offset reference voltage is not limited thereto, and other methods may also be used to determine the offset reference voltage, such as presetting an offset reference voltage.

Further, the voltage adjustment method further includes:

subsequent to the decreasing the initial pixel voltage of each pixel on the display screen of the current frame of the display device by the offset reference voltage, decreasing a power supply voltage of the display device, so that a difference between the power supply voltage and a maximum pixel voltage among decreased pixel voltages of all pixels on the display screen of the current frame to be not larger than a preset threshold.

After decreasing the common voltage and all initial pixel voltages of the display screen of the current frame, the power supply voltage of the display device may also be decreased as long as the power supply voltage of the display device is larger than the maximum pixel voltage of the display screen of the current frame.

Further, the initial pixel voltage of each pixel on the display screen of the current frame is larger than the minimum gamma voltage, and the offset reference voltage is a positive voltage.

The voltage adjustment method of the present disclosure is described below with reference to the accompanying drawings and specific embodiments.

Figure 2:
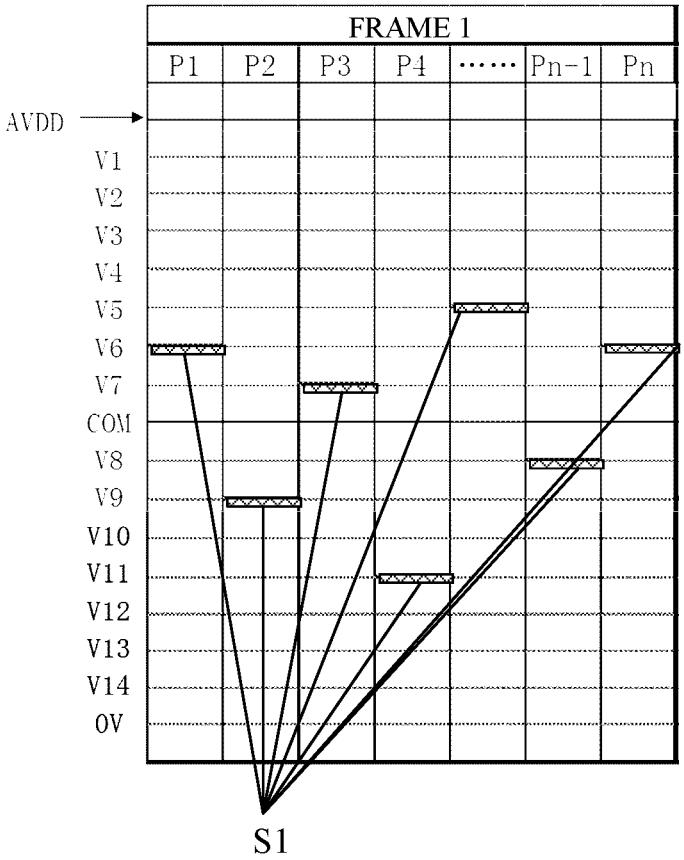
FIG. 2 to FIG. 4 are schematic views of voltage adjustment in an embodiment of the present disclosure.

As shown in FIG. 2, a vertical axis denotes a pixel electrode voltage level, and a horizontal axis denotes all sub-pixels in a display area. In a display mode of a liquid crystal display in the related art, as shown in FIG. 2, in the case that the display device is displaying an image, pixel voltages S1 of all sub-pixels are between V5 and V11, and a common voltage (VCOM) is between V7 and V8, V14 is a minimum gamma voltage. An AVDD voltage (a power supply voltage) is kept larger than a maximum pixel voltage of the display device which is a highest voltage value that the display device can display. At this time, each voltage is at a higher voltage level, the power consumption of the display device is relatively high, and thus the display device has a short standby time.

Figure 4:
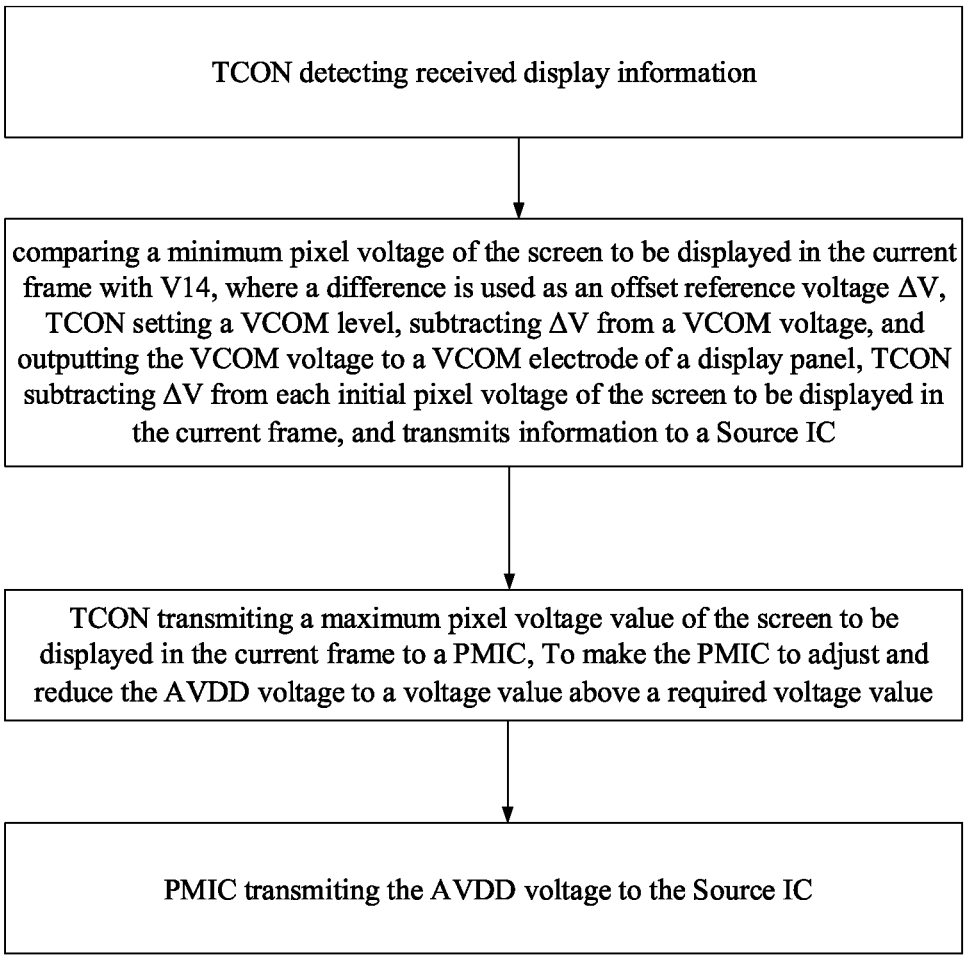

In this embodiment, in order to reduce the power consumption of the display device, the pixel voltage of the display screen is decreased. For a display screen in which the pixel voltage may be decreased, the initial pixel voltage must be larger than the minimum gamma voltage V14. In this embodiment, as shown in FIG. 4, a Timer Control Register (TCON) detects received display information including an initial pixel voltage of a screen to be displayed in the current frame, compares a minimum pixel voltage of the screen to be displayed in the current frame with V14, and a difference is used as an offset reference voltage ΔV. The TCON sets a VCOM level, subtracts ΔV from a VCOM voltage, and outputs the VCOM voltage to a VCOM electrode (i.e., a common electrode) of a display panel. At the same time, the TCON subtracts ΔV from each initial pixel voltage of the screen to be displayed in the current frame, and transmits information to a Source IC (i.e., a source driving circuit).

Further, the TCON transmits a maximum pixel voltage value of the screen to be displayed in the current frame to a Power Management Integrated Circuit (PMIC), so that the PMIC can adjust and reduce the AVDD voltage to a voltage value above a required voltage value. The PMIC transmits the AVDD voltage to the Source IC to use as a power for an output pixel voltage.

Figure 3:
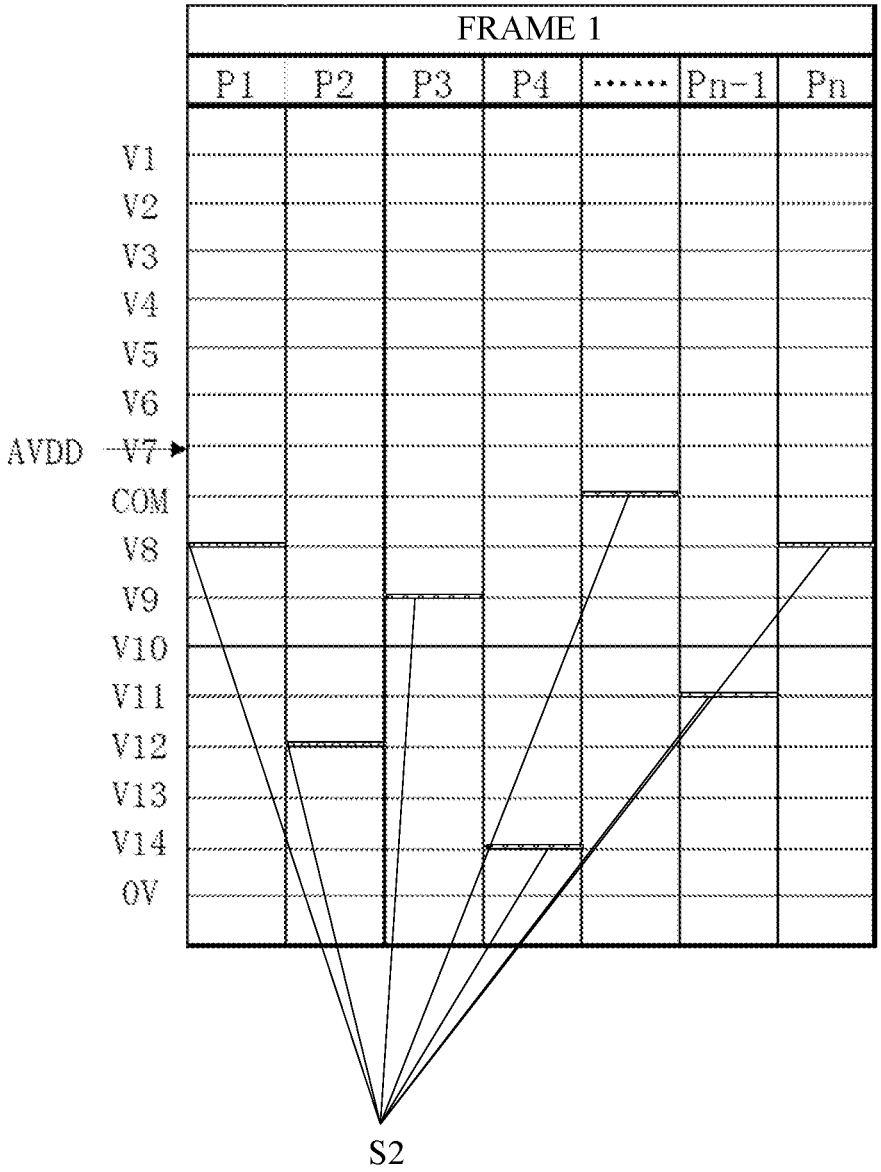

As shown in FIG. 2, in the display mode of the liquid crystal display in the related art, all pixel voltages S1 are between V5 and V11. After adopting the technical solution of this embodiment, as shown in FIG. 3, all adjusted pixel voltages S2 are between V8 and V14. All pixel voltages are decreased by three voltage levels, which effectively reduces the pixel voltages and the AVDD voltage of the display device, thereby reducing the power consumption of the display device and extending the standby time of the display device.

Figure 5:
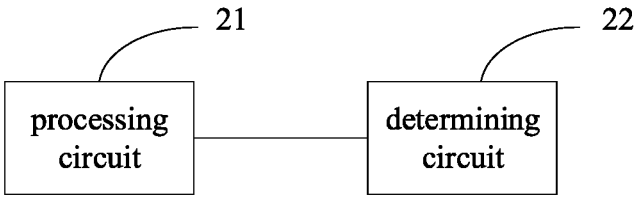
FIG. 5 is a structural block diagram of a voltage adjustment device in an embodiment of the present disclosure.

A voltage adjustment device is further provided in the embodiments of the present disclosure, applied to a display device, as shown in FIG. 5, the voltage adjustment device includes:

a processing circuit 21, configured to subtract an offset reference voltage from a common voltage of the display device; and decrease an initial pixel voltage of each pixel on the display screen of the current frame of the display device by the offset reference voltage, so that a decreased minimum pixel voltage of the display screen of the current frame is not smaller than a minimum gamma voltage of the display device.

In this embodiment, in the case that all pixel voltages of the display screen of the current frame are larger than the minimum gamma voltage of the display device, the common voltage and all the initial pixel voltages of the display screen of the current frame are simultaneously decreased, as long as the decreased minimum pixel voltage of the display screen of the current frame is not smaller than the minimum gamma voltage of the display device, and at the same time, a voltage difference between each pixel voltage of the display screen of the current frame and the common voltage may be maintained as a voltage difference required for normal display, so that voltages of the display screen of the current frame are at relatively low voltage levels, thereby reducing the power consumption of the display device.

Further, as shown in FIG. 5, the voltage adjustment device further includes:

a determining circuit 22, configured to determine the offset reference voltage, where the offset reference voltage is smaller than or equal to a voltage obtained by subtracting the minimum gamma voltage of the display device from a minimum initial pixel voltage among initial pixel voltages of all pixels on the display screen of the current frame of the display device.

Before reducing the common voltage and all the initial pixel voltages of the display screen of the current frame, it is necessary to determine the offset reference voltage. The offset reference voltage must ensure that the decreased minimum pixel voltage of the display screen of the current frame is not smaller than the minimum gamma voltage of the display device. Since the common voltage and all the initial pixel voltages of the display screen of the current frame are decreased by a same magnitude, the voltage difference between each pixel voltage of the display screen of the current frame and the common voltage may be maintained as the voltage difference required for normal display, and a display of the display screen of the current frame may not be affected.

Further, the determining circuit 22 is configured to take the voltage obtained by subtracting the minimum gamma voltage from the minimum initial pixel voltage of the display screen of the current frame of the display device as the offset reference voltage. Thus, the decreased minimum pixel voltage of the display screen of the current frame is equal to the minimum gamma voltage of the display device, which can reduce voltage levels of the display screen of the current frame to a maximum magnitude while ensuring the normal display of the display device, thereby reducing the power consumption of the display device to the full extent.

Further, the processing circuit 21 is further configured to decrease a power supply voltage of the display device, so that a difference between the power supply voltage and a maximum pixel voltage among decreased pixel voltages of all pixels on the display screen of the current frame to be not larger than a preset threshold.

After reducing the common voltage and all initial pixel voltages of the display screen of the current frame, the power supply voltage of the display device may also be decreased as long as the power supply voltage of the display device is larger than the maximum pixel voltage of the display screen of the current frame.

A voltage adjustment device is further provided in the embodiments of the present disclosure, including: a memory, a processor, and a computer program stored in the memory and executable by the processor, the processor is configured to execute the computer program to perform the voltage adjustment method as described above.

A computer-readable storage medium is further provided in the embodiments of the present disclosure, storing a computer program, the computer program is executed by a processor to perform the voltage adjustment method as described above.

The computer-readable storage medium includes permanent and non-permanent, removable and non-removable media, and can realize information storage by using any method or technology. The information may be computer-readable instructions, data structures, modules of a program, or other data. Examples of computer storage media include, but are not limited to, a Phase-Change Random Access Memory (PRAM), a Static Random Access Memory (SRAM), a Dynamic Random Access Memory (DRAM), other types of Random Access Memories (RAM), a Read-Only Memory (ROM), an Electrically Erasable Programmable Read-Only Memory (EEPROM), a flash memory or other memory technology, a Compact Disc Read-Only Memory (CD-ROM), a Digital Versatile Disk (DVD) or other optical memories, a magnetic tape cartridge, a magnetic tape storage or other magnetic storage devices, or any other non-transmission media, and may be used to store information that may be accessed by a computing device. As defined herein, the computer readable media does not include temporary computer readable media, such as modulated data signals and carrier waves.

A display device is further provided in the embodiment of the present disclosure, including the voltage adjustment device as described above. The display device may be any product or component having a display function, such as a liquid crystal television, a liquid crystal display, a digital photo frame, a mobile phone, and a tablet computer. The display device further includes a flexible circuit board, a printed circuit board and a back plate.

Unless defined otherwise, technical or scientific terms in the present disclosure shall be of general meanings understood by those with ordinary skills in the art. Terms "first", "second" and similar terms in the embodiments of the present disclosure do not indicate any order, quantity or importance, but are used only for distinguishing different components. A term "include", "comprise" or other term with similar meaning indicates that components or objects before the term cover components, objects or other equivalents listed after the term, instead of excluding other components or objects. A term "connect", "attach" or other term with similar meaning is not limited to a physical connection or a mechanical connection, but may include an electrical connection, whether direct or indirect. "Up", "down", "left", "right" and so on are only used to represent a relative position relationship. When an absolute position of an object is changed, the relative position relationship may also change accordingly.

It should be appreciated that, when a component such as a layer, film, region or substrate is said to be located "above" or "below" another component, the component may be "directly" located "above" or "below" another component, or intermediate components may exist.

The above are merely embodiments of the present disclosure, it should be appreciated that those of ordinary skill in the art may make further modifications and improvements without departing from the principle of the present disclosure, and these modifications and improvements shall also fall within the scope of the present disclosure.

What is claimed is:

1. A voltage adjustment method, applied to a display device and comprising:

determining an offset reference voltage, wherein the offset reference voltage is smaller than or equal to a voltage obtained by subtracting a minimum gamma voltage of the display device from a minimum initial pixel voltage among initial pixel voltages of all pixels on a display screen of a current frame of the display device;

decreasing a common voltage of the display device by the offset reference voltage; and decreasing an initial pixel voltage of each pixel on the display screen of the current frame of the display device by the offset reference voltage.

2. The voltage adjustment method according to claim 1, wherein the determining the offset reference voltage comprises:

taking the voltage obtained by subtracting the minimum gamma voltage from the minimum initial pixel voltage of the display screen of the current frame of the display device as the offset reference voltage.

3. The voltage adjustment method according to claim 1, further comprising:

subsequent to the decreasing the initial pixel voltage of each pixel on the display screen of the current frame of the display device by the offset reference voltage, decreasing a power supply voltage of the display device, to make a difference between the power supply voltage and a maximum pixel voltage among decreased pixel voltages of all pixels on the display screen of the current frame to be not larger than a preset threshold.

4. The voltage adjustment method according to claim 1, wherein the initial pixel voltage of each pixel on the display screen of the current frame is larger than the minimum gamma voltage, and the offset reference voltage is a positive voltage.

5. A voltage adjustment device, comprising: a memory, a processor, and a computer program stored in the memory and executable by the processor, wherein the processor is configured to execute the computer program to perform the voltage adjustment method according to claim 1.

6. A computer-readable storage medium storing a computer program, wherein the computer program is executed by a processor to perform the voltage adjustment method according to claim 1.

7. A voltage adjustment device, wherein the voltage adjustment device is configured to be applied to a display device and the voltage adjustment device comprises:

a determining circuit, configured to determine an offset reference voltage, wherein the offset reference voltage is smaller than or equal to a voltage obtained by subtracting a minimum gamma voltage of the display device from a minimum initial pixel voltage among initial pixel voltages of all pixels on a display screen of a current frame of the display device; and a processing circuit, configured to decrease a common voltage of the display device by the offset reference voltage; and decrease an initial pixel voltage of each pixel on the display screen of the current frame of the display device by the offset reference voltage.

8. The voltage adjustment device according to claim 7, wherein the determining circuit is configured to take the voltage obtained by subtracting the minimum gamma voltage from the minimum initial pixel voltage of the display screen of the current frame of the display device as the offset reference voltage.

9. The voltage adjustment device according to claim 7, wherein the processing circuit is further configured to decrease a power supply voltage of the display device, to make a difference between the power supply voltage and a maximum pixel voltage among decreased pixel voltages of all pixels on the display screen of the current frame to be not larger than a preset threshold.

10. The voltage adjustment device according to claim 7, wherein the initial pixel voltage of each pixel on the display screen of the current frame is larger than the minimum gamma voltage, and the offset reference voltage is a positive voltage.

11. A display device comprising the voltage adjustment device according to claim 7.

* * * * *